US007445306B2

(12) United States Patent
Hirota

(10) Patent No.: US 7,445,306 B2
(45) Date of Patent: Nov. 4, 2008

(54) LINE-TYPE INK-JET RECORDING APPARATUS

(75) Inventor: Atsushi Hirota, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 296 days.

(21) Appl. No.: 11/224,289

(22) Filed: Sep. 13, 2005

(65) Prior Publication Data

US 2006/0055717 A1 Mar. 16, 2006

(30) Foreign Application Priority Data

Sep. 14, 2004 (JP) ..... 2004-266827

(51) Int. Cl.
*B41J 29/38* (2006.01)

(52) U.S. Cl. ..... 347/12; 347/9

(58) Field of Classification Search ..... 347/9, 347/12, 40, 42, 71, 70, 72, 41
See application file for complete search history.

(56) References Cited

U.S. PATENT DOCUMENTS 5,087,930 A * 2/1992 Roy et al. ..... 347/85
5,142,296 A 8/1992 Lopez et al.
5,844,801 A 12/1998 Kodama et al.
6,431,691 B1 * 8/2002 Tanikawa et al. ..... 347/70
6,616,258 B2 9/2003 Maeda
2003/0146947 A1 8/2003 Ozaki et al.

FOREIGN PATENT DOCUMENTS

| | | |
|---|---|---|
| EP | 0 551 013 | 7/1993 |
| EP | 1 176 019 | 1/2002 |
| JP | 8-254412 | 10/1996 |
| JP | 10-315451 | 12/1998 |
| JP | 2002-301816 | 10/2002 |

* cited by examiner

*Primary Examiner*—Matthew Luu
*Assistant Examiner*—Lisa M Solomon
(74) *Attorney, Agent, or Firm*—Banner & Witcoff, Ltd.

(57) ABSTRACT

A line-type ink-jet recording apparatus includes a conveyance mechanism, a passage unit, a plurality of actuators, and an actuator controller. The actuator controller supplies an ejection signal to each of the actuators so that ink is ejected from n ejection openings communicating with a same one of the common ink chambers at m different timings within one printing cycle and that ink is ejected from each of the n ejection openings at two or more different timings among the m timings within a printing period including two or more of the printing cycles.

15 Claims, 12 Drawing Sheets

LINE-TYPE INK-JET RECORDING APPARATUS

BACKGROUND OF THE INVENTION

1. Field of the Invention

The present invention relates to a line-type ink-jet recording apparatus which ejects ink from ejection openings to form an image.

2. Description of Related Art

A head of a line-type ink-jet recording apparatus extends in a direction perpendicular to a conveyance direction for a print medium such as a paper. The head includes a unit in a lower face of which many ejection openings that eject ink to a print medium are formed. Pressure chambers communicating with respective ejection openings are formed in an upper face of the unit. In addition, formed within the unit is common ink chambers each corresponding to two or more pressure chambers and storing therein ink which will be supplied to the pressure chambers. Moreover, individual ink passages each extending from an outlet of each of the common ink chambers through a pressure chamber to an ejection opening are formed in the unit. An actuator having layered piezoelectric sheets made of, e.g., a piezoelectric ceramic material is disposed in each region of an upper face of the unit corresponding to each of the pressure chambers. Ink is supplied from an ink tank, and then distributed through the common ink chambers to the respective pressure chambers. Selectively driving the actuators causes corresponding pressure chambers to be reduced in volume, thereby applying pressure to ink contained in the respective pressure chambers. Consequently, the ink is ejected from ejection openings communicating with the pressure chambers.

When many of the actuators are driven at the same timing for the purpose of simultaneous ink ejection from the corresponding ejection openings, the current consumed reaches a high peak value and therefore a power supply having a high capacity is needed. In this case, moreover, there arises a phenomenon that vibration caused upon driving of an arbitrary actuator hinders driving of another neighboring actuator, which is so-called mechanical crosstalk. This deteriorates accuracy in ink ejection. In order to solve these problems, according to a known technique, many ejection openings are classified into multiple groups and the actuators are controlled in such a manner that the ejection opening groups may differ from each other in ink ejection timing (see Japanese Patent Unexamined Publication No. 10-315451).

On the other hand, if the actuators are driven at the same timing, pressure waves which have propagated from pressure chambers communicating with one common ink chamber may resonate to thereby generate a standing wave within the common ink chamber. The standing wave generated within one common ink chamber causes a phenomenon that pressure fluctuation occurs in an arbitrary individual ink passage communicating with the common ink chamber to thereby produce pressure fluctuation in another individual ink passage communicating with the same common ink chamber, which is so-called fluid crosstalk. To what degree the fluid crosstalk via one common ink chamber has influence on ink ejection is related to a timing of ink ejection from the ejection openings and to positions where the individual ink passages are connected to the common ink chamber.

According to the technique disclosed in the aforementioned document, a timing of ink ejection is differentiated among the ejection opening groups. However, each ejection opening ejects ink at the constant timing and therefore fluid crosstalk having a constant magnitude occurs via a common ink chamber. Thus, the problem of fluid crosstalk described above remains unsolved. That is, each ejection opening exhibits a certain lag in ink ejection characteristics, and a resulting printing includes a relatively clear noise, e.g., uneven density, un-uniform diameters and positions of dots, etc.

SUMMARY OF THE INVENTION

An object of the present invention is to provide a line-type ink-jet recording apparatus capable of suppressing fluid crosstalk which is produced via a common ink chamber.

According to an aspect of the present invention, there is provided a line-type ink-jet recording apparatus comprising a conveyance mechanism, a passage unit, a plurality of actuators, and an actuator controller. The conveyance mechanism conveys a print medium. The passage unit is provided with one or more common ink chambers that store ink and a plurality of individual ink passages each extending from an outlet of each of the common ink chambers through a pressure chamber to an ejection opening. The passage unit extends in a direction intersecting a conveyance direction for the print medium which is conveyed by the conveyance mechanism. The plurality of actuators applies ejection energy to ink contained in respective pressure chambers so that the ink is ejected from an ejection opening communicating with the pressure chambers. The actuator controller supplies an ejection signal to each of the actuators so that ink is ejected from n ejection openings communicating with a same one of the common ink chambers at m different timings within one printing cycle and that ink is ejected from each of the n ejection openings at two or more different timings among the m timings within a printing period including two or more of the printing cycles. The printing cycle represents a time required for the print medium to be conveyed by a unit distance corresponding to a printing resolution with respect to the conveyance direction. Here, n is a natural number no less than 2 and m is a natural number no less than 2 and equal to or less than n.

In this aspect, an ejection signal is supplied to each of the actuators so that ink is ejected from n ejection openings communicating with the same one of the common ink chambers at two or more different timings within one printing cycle and that a timing of ink ejection from each of the n ejection openings is varied within the printing period. This suppresses fluid crosstalk via a common ink chamber.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
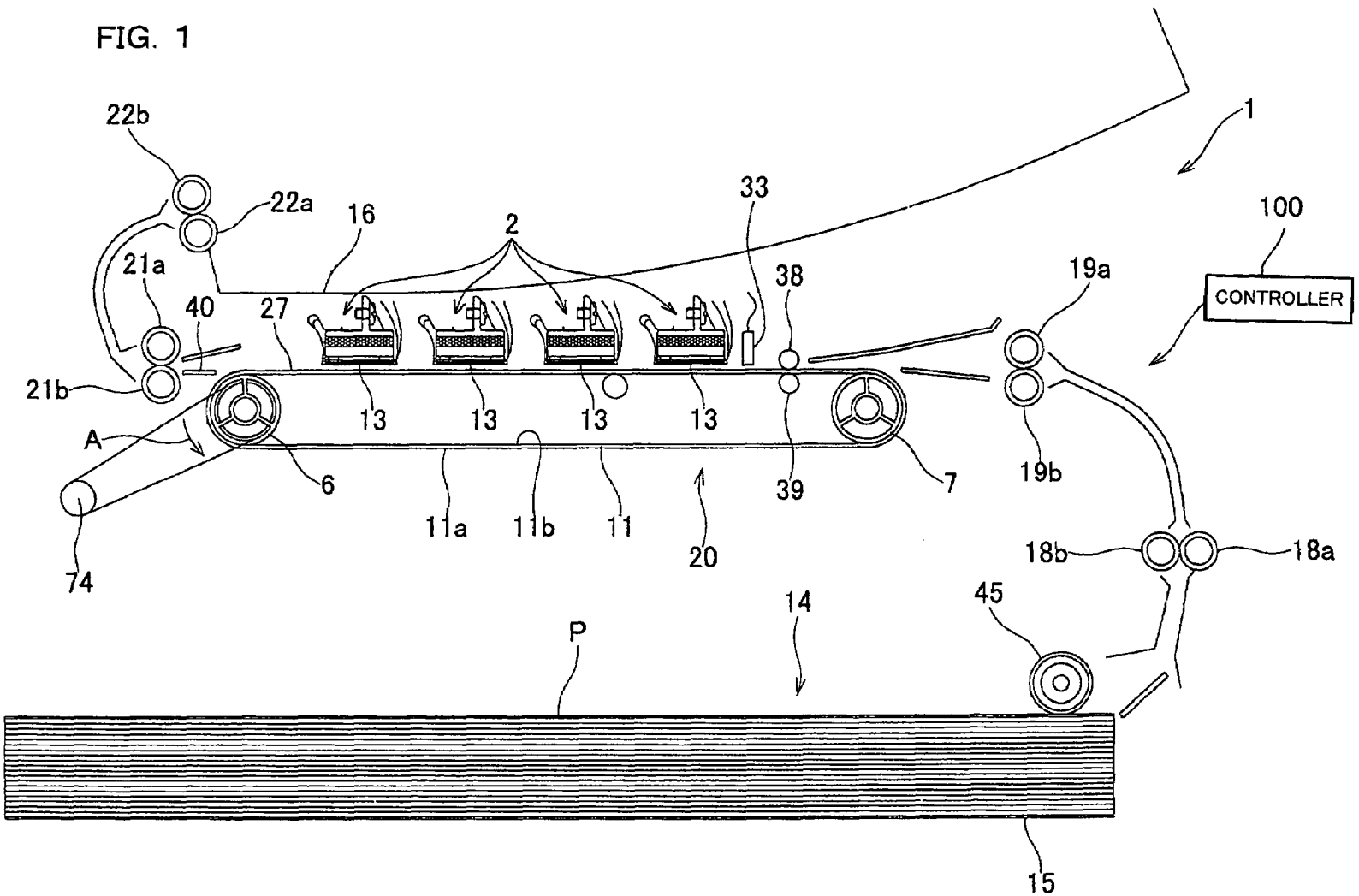
FIG. 1 schematically illustrates a construction of an ink-jet printer according to a first embodiment of the present invention.

First, an ink-jet printer according to a first embodiment of the present invention will be described with reference to FIG. 1. A printer 1 is a color ink-jet printer of line-head type and includes four fixed ink-jet heads 2 each having a rectangular shape in a plan view and extending in a direction perpendicular to the drawing sheet of FIG. 1. The printer 1 is provided with a paper feeder 14 in its lower part, a paper catcher 16 in its upper part, and a conveyance unit 20 in its middle part. The printer 1 further includes a controller 100 (see FIG. 6) that controls the above-described units.

The paper feeder 14 includes a paper stacker 15 in which papers P as recording media can be stacked, and a paper feed roller 45 that sends toward the conveyance unit 20 the topmost one of papers P that are stacked in the paper stacker 15. The paper P is stacked in the paper stacker 15 in such a manner that it may be fed out in a direction along its longer side.

Pairs of feed rollers 18*a*, 18*b* and 19*a*, 19*b* are disposed along a paper conveyance path between the paper feeder 15 and the conveyance unit 20. Referring to FIG. 1, the paper P fed out of the paper feeder 14 is sent upward with its one shorter side, i.e., leading edge, being pinched in the pair of feed rollers 18*a*, 18*b*, and then sent toward the conveyance unit 20 by means of the pair of feed rollers 19*a*, 19*b*.

The conveyance unit 20 includes two belt rollers 6 and 7, and a looped conveyor belt 11 spanning these rollers 6 and 7. The belt rollers 6 and 7 are in contact with an inner surface 11*b* of the conveyor belt 11. One belt roller 6 located on a downstream part in the paper conveyance direction (i.e., on a left side in FIG. 1) is a drive roller and connected to a conveyance motor 74 that is driven under control of the controller 100. The other belt roller 7 is a slave roller and rotated by rotary force which is caused by rotation of the belt roller 6 and given through the conveyor belt 11.

A length of the conveyor belt 11 is adjusted such that predetermined tension may arise in the belt 11 between the belt rollers 6 and 7. The conveyor belt 11, which is wrapped around the belt rollers 6 and 7 to span them, forms two parallel planes each including a common tangent to the belt rollers 6 and 7. The upper one of the two planes facing the heads 2 provides a conveyor face 27 for the paper P. An outer surface 11*a* of the conveyor belt 11 is treated with an adhesive silicone rubber. Therefore, in association with rotation of the belt roller 6 in a counterclockwise direction in FIG. 1 as indicated by an arrow A, the paper P can be conveyed while kept onto the conveyor face 27 of the conveyor belt 11.

Nip rollers 38 and 39 are disposed near the belt roller 7 in such a manner that they may sandwich the belt roller 11. Each of the nip rollers 38 and 39 has a rotatable cylindrical body whose length is substantially equal to an axial length of the belt roller 7. A spring (not shown) biases the nip roller 38 so that the nip roller 38 can press the paper P against the conveyor face 27 of the conveyor belt 11. The nip rollers 38 and 39 nip the paper P together with the conveyor belt 11, in order to ensure that the paper P can be kept on the conveyor face 27 without separation therefrom.

A peeling plate 40 locates near the belt roller 6. An end portion of the peeling plate 40 gets into between the paper P and the conveyor face 27 of the conveyor belt 11, so that the paper P kept on the conveyor face 27 of the conveyor belt 11 is peeled away from the conveyor face 27.

Pairs of feed rollers 21*a*, 21*b*, and 22*a*, 22*b* are provided between the conveyance unit 20 and the paper catcher 16. Referring to FIG. 1, the paper P fed out of the conveyor unit 20 is sent upward with its one shorter side, i.e., leading edge, being pinched in the pair of feed rollers 21*a*, 21*b*, and then sent toward the paper catcher 16 by means of the pair of feed rollers 22*a*, 22*b*. Printed papers P are stacked in the paper catcher 16 one after another.

A paper sensor 33 is disposed between the nip roller 38 and the most upstream ink-jet head 2 in the paper conveyance direction. The paper sensor is an optical sensor that includes a light-emitting element and a light-receiving element. When a leading edge of the paper P reaches a detection position, the paper sensor 33 outputs a detection signal in accordance with which a print signal is supplied to the heads 2.

Each of the four heads 2 has a head main body 13 at its lower end. The four head main bodies 13 are arranged adjacent to one another along a horizontal direction of FIG. 1. Many nozzles 8 each having a small diameter are formed in a lower face of each head main body 13. An opening of the nozzle 8 opening in the lower face of the head main body 13 serves as an ejection opening. The four head main bodies 13 eject from their nozzles 8 magenta ink, yellow ink, cyan ink, and black ink, respectively.

A narrow gap is formed between the lower face of the head main body 13 and the conveyor face 27 of the conveyor belt 11. The paper P is conveyed through this gap from right to left in FIG. 1. While the paper P is passing under the four head main bodies 13, ink is ejected from the nozzles 8 to the paper P in accordance with image data, so that a desired color image is formed on the paper P.

Figure 2:
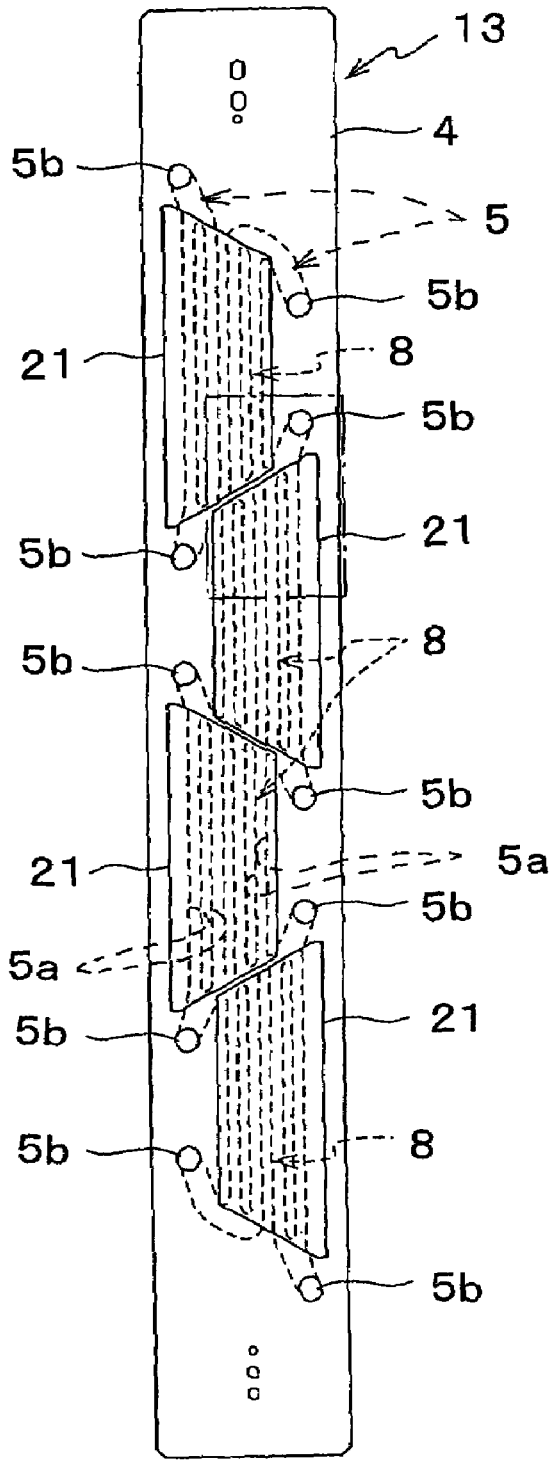
FIG. 2 is a plan view of a head main body that is included in the printer of FIG. 1.

Next, the head main body 13 will be described in more detail with reference to FIGS. 2, 3, and 4. The head main body 13 includes a passage unit 4, and four trapezoidal actuator units 21 (see FIG. 2). The passage unit 4 has a rectangular shape in a plan view and extends in a direction perpendicular to the paper conveyance direction.

Figure 4:
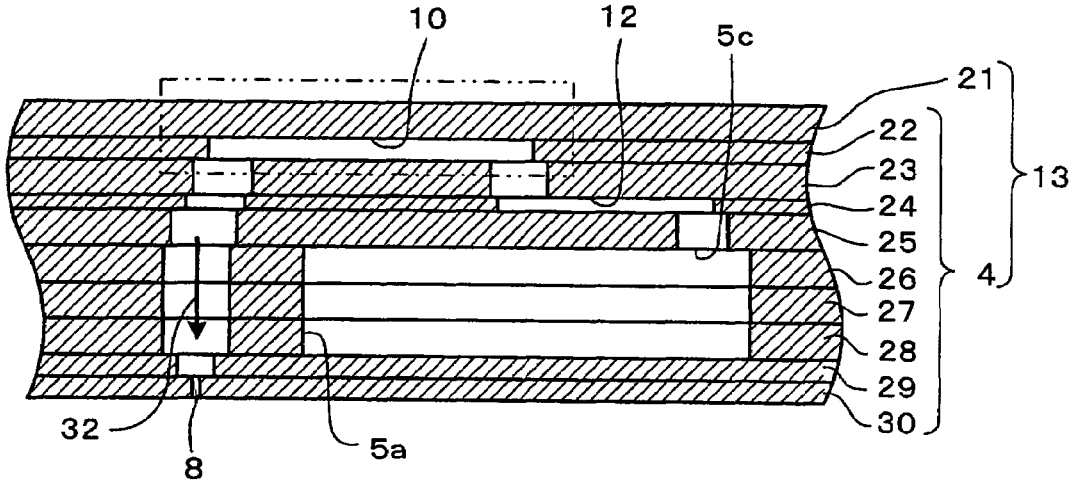
FIG. 4 is a sectional view taken along a line IV-IV in FIG. 3.

As shown in FIG. 4, many ejection openings, each of which is formed at a tip end of each nozzle 8 and through which ink is ejected to the paper P, are formed in a lower face of the passage unit 4. Pressure chambers 10 each communicating with each nozzle 8 are formed in an upper face of the passage unit 4. In addition, formed within the passage unit 4 are sub manifold channels 5*a* each corresponding to many pressure chambers 10 in order to store ink which will be supplied to these corresponding pressure chambers 10. The sub manifold channel 5*a* branches from a manifold channel 5. The manifold channel 5 and the sub manifold channel 5*a* correspond to a "common ink chamber" and a "predetermined region of the common ink chamber", respectively. Also formed in the passage unit 4 are individual ink passages 32 each extending from an outlet 5*c* of each of the sub manifold channels 5*a* through a pressure chamber 10 to an ejection opening of a nozzle 8.

The actuator unit 21 applies pressure to ink contained in a desired one of the many pressure chambers 10. As shown in FIGS. 3 and 4, the actuator unit 21 is bonded to an upper face of the passage unit 4 so that it may cover many pressure chambers 10. As shown in FIG. 2, the four actuator units 21 are arranged in two rows in a zigzag pattern. Parallel opposed sides, i.e., upper and lower sides, of each trapezoidal actuator unit 21 are along an extension direction of the passage unit 4, i.e., along a vertical direction in FIG. 2. Oblique sides of every neighboring actuator unit 21 overlap each other with respect to a widthwise direction of the passage unit 4, i.e., a horizontal direction in FIG. 2.

Figure 3:
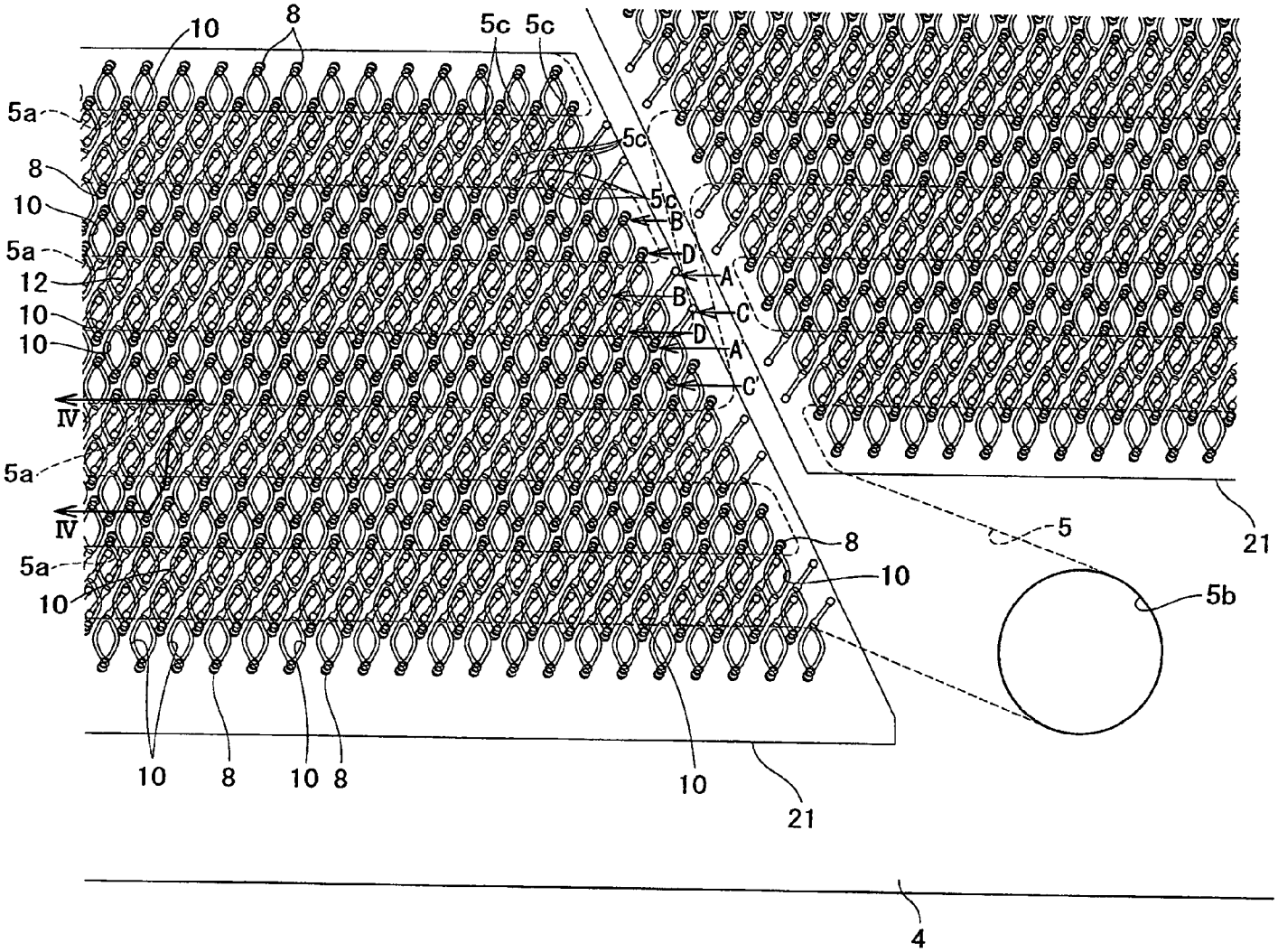
FIG. 3 is an enlarged view of a region shown in FIG. 2 enclosed with an alternate long and short dash line.

As shown in FIG. 3, many ejection openings of the nozzles 8 and many pressure chambers 10 each having a rhombic shape in a plan view are formed in a matrix within a region of the passage unit 4 where each actuator unit 21 is bonded. The sub manifold channel 5*a*, which branches from the manifold channel 5, extends across many pressure chambers 10 along the extension direction of the passage unit 4. Four sub manifold channels 5*a* correspond to one actuator unit 21. As shown in FIG. 2, openings 5*b* which communicate with the manifold channel 5 are formed in the upper face of the passage unit 4. Ink is supplied from an ink tank (not shown) through the openings 5*b* to the manifold channels 5.

Referring to FIG. 3, outlets 5*c* of one sub manifold channel 5*a* leading to the respective pressure chambers 10 form four outlet rows A to D that are parallel to one another along an extension direction of this sub manifold channel 5*a*, i.e., along the extension direction of the passage unit 4 which is perpendicular to the paper conveyance direction. Ejection openings of nozzles 8 communicating with one sub manifold channel 5*a* form four nozzle rows A' to D' that are parallel to one another along an extension direction of this sub manifold channel 5*a*. That is, four outlet rows A to D and four nozzle rows A' to D' correspond to one sub manifold channel 5*a*.

Ejection openings of the nozzles 8, pressure chambers 10, apertures 12, etc., which locate below the actuator unit 21, should be illustrated with broken lines, but in FIG. 3 they are illustrated with solid lines for the purpose of easy understanding of the figure.

Next, a construction of the passage unit 4 will be described in more detail with reference to FIG. 4.

The passage unit 4 has a layered structure of, from the top, a cavity plate 22, a base plate 23, an aperture plate 24, a supply plate 25, manifold channel plates 26, 27, 28, a cover plate 29, and a nozzle plate 30.

The cavity plate 22 is a metal plate in which formed are many rhombic holes serving as the pressure chambers 10. The base plate 23 is a metal plate in which formed are many communication holes each connecting each pressure chamber 10 to a corresponding aperture 12 and many communication holes each connecting each pressure chamber 10 to a corresponding nozzle 8. The aperture plate 24 is a metal plate in which formed are many holes serving as apertures 12 and many communication holes each connecting each pressure chamber 10 to a corresponding nozzle 8. The supply plate 25 is a metal plate in which formed are many communication holes each connecting each aperture 12 to a sub manifold channel 5*a* and many communication holes each connecting each pressure chamber 10 to a corresponding nozzle 8. The manifold channel plates 26, 27, and 28 are metal plates in which formed are holes serving as the sub manifold channels 5*a* and many communication holes each connecting each pressure chamber 10 to a corresponding nozzle 8. The cover plate 29 is a metal plate in which formed are many communication holes each connecting each pressure chamber 10 to a corresponding nozzle 8. The nozzle plate 30 is a metal plate in which many nozzles 8 are formed. These nine metal plates are positioned to and layered on one another so that the individual ink passages 32 may be formed therein.

Next, a construction of the actuator unit 21 will be described with reference to FIGS. 5A and 5B.

Figure 5A:
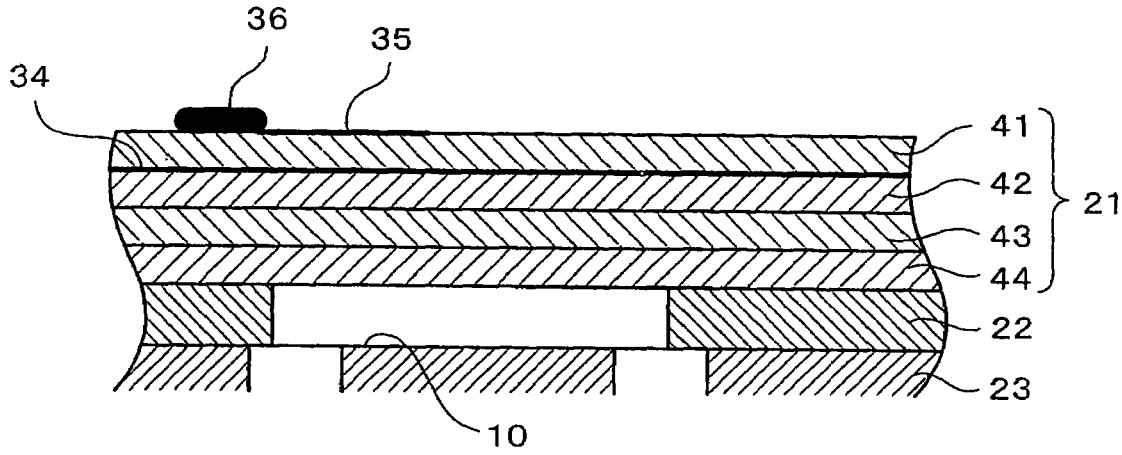
FIG. 5A is an enlarged view of a region shown in FIG. 4 enclosed with an alternate long and two short dashes line.

As shown in FIG. 5A, the actuator unit 21 has four piezoelectric sheets 41, 42, 43, and 44 that are layered on one another. The piezoelectric sheets 41 to 44, each having a thickness of approximately 15 μm and a trapezoidal shape in a plan view, are made of a lead zirconate titanate (PZT)-base ceramic material having ferroelectricity.

Individual electrodes 35 each corresponding to each pressure chamber 10 are formed on the uppermost piezoelectric sheet 41. A common electrode 34 of approximately 2 μm thickness are interposed between the uppermost piezoelectric sheet 41 and the piezoelectric sheet 42 disposed thereunder in such a manner that the common electrode 34 may be formed over an entire surface of the piezoelectric sheets. No electrode exists between the piezoelectric sheet 42 and the piezoelectric sheet 43 and between the piezoelectric sheet 43 and the piezoelectric sheet 44. The individual electrodes 35 and the common electrode 34 are made of, e.g., an Ag—Pd-base metallic material.

Figure 5B:
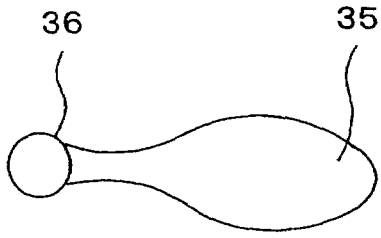
FIG. 5B is a top view of an individual electrode that is formed on a surface of an actuator unit.

The individual electrode 35 has a thickness of approximately 1 μm, and as shown in FIG. 5B has a substantially rhombic planar shape which is almost similar to a planar shape of the pressure chamber 10 (see FIG. 3). One acute portion of the substantially rhombic individual electrode 35 is extended out, and a circular land 36 is provided at an end of this extended-out portion. The land 36 is electrically connected to the individual electrode 35, and has a thickness of approximately 160 μm. The land 36 is made of, e.g., gold including glass frits and bonded onto a surface of the extended-out portion of the individual electrode 35, as shown in FIG. 5A.

The common electrode 34 is grounded and kept at the ground potential equally at a region corresponding to every pressure chamber 10 of the passage unit 4. On the other hand, the individual electrodes 35 each corresponding to each pressure chamber 10 are electrically connected to a driver IC (not shown) of the controller 100 independently of one another such that a potential of one individual electrode 35 may be controlled independently of a potential of another individual electrode 35.

Next, driving of the actuator unit 21 will be described.

The actuator unit 21 is of the so-called unimorph type, and the uppermost piezoelectric sheet 41 is polarized in its thickness direction. The piezoelectric sheet 41 has many active portions sandwiched between the respective individual electrodes 35 and the common electrode 34, while the other piezoelectric sheets 42 to 44 have no active portion. An actuator for each pressure chamber 10 is constituted by the active portion, an individual electrode 35 corresponding to the active portion, a portion of the common electrode 34 corresponding thereto and portions of the piezoelectric sheets 42 to 44 corresponding thereto.

While there is no ejection request, for example, the individual electrode 35 is kept at a potential (hereinafter referred to as a "low potential") equal to the potential of the common electrode 34, and upon an ejection request the individual electrode 35 is set at a potential (hereinafter referred to as a "high potential") higher than that of the common electrode 34, so that ink is ejected from the nozzle B. While the individual electrode 35 is having the low potential, the piezoelectric sheets 41 to 44 keep a flat shape. When the individual electrode 35 is set at the high potential so that an electric field occurs in the thickness direction of the piezoelectric sheet 41 which is the same as the polarization direction, an active portion of the piezoelectric sheet 41 corresponding to this individual electrode 35 contracts by a transversal piezoelectric effect in a direction along a plane of the sheet which is perpendicular to the thickness direction. At this time, the other piezoelectric sheets 42 to 44 are not affected by the electric field and therefore do not contract by themselves. Accordingly, the uppermost piezoelectric sheet 41 and the other piezoelectric sheets 42 to 44 exhibit different strains along the plane of the sheet. As a result, the piezoelectric sheets 41 to 44 as a whole are deforming downward into a convex shape, i.e., present a unimorph deformation. Here, as shown in FIG. 5A, the piezoelectric sheets 41 to 44 are fixed to an upper face of the cavity plate 22 in which the holes serving as the pressure chambers 10 are formed. Therefore, the piezoelectric sheets 41 to 44 deform into a convex shape toward the pressure chambers 10. This deformation causes the volume of the pressure chamber 10 to be reduced and pressure of ink contained in the pressure chamber 10 rises, consequently ejecting ink from the nozzle 8. Then, when the individual electrode 35 is set at the low potential, the piezoelectric sheets 41 to 44 is going to restore their original flat shape. At this time, pressure in the pressure chamber 10 changes so that ink flows from the sub manifold channel 5*a* into the pressure chamber 10.

This embodiment adopts a driving mode different from the above-described one. In accordance with the driving mode adopted in this embodiment, while there is no ejection request the individual electrode 35 is kept at the high potential, and upon an ejection request the individual electrode 35 is set at the low potential and then at the high potential again at a predetermined timing. While the individual electrode 35 is having the high potential, the piezoelectric sheets 41 to 44 take a convex shape toward the pressure chamber 10 as described above. When the individual electrode 35 is set at the low potential, the piezoelectric sheets 41 to 44 become flat so that the volume of the pressure chamber 10 increases as compared with at the high potential. At this time, the pressure chamber 10 incurs negative pressure therein, so that ink flows from the sub manifold channel 5*a* into the pressure chamber 10. Then, when the individual electrode 35 is set at the high potential again, the piezoelectric sheets 41 to 44 deform again into a convex shape toward the pressure chamber 10. This reduces the volume of the pressure chamber 10 and thus the pressure chamber 10 incurs positive pressure therein. Increased pressure is therefore given to ink contained in the pressure chamber 10, to eject ink from the nozzle 8. In order to adopt such a driving mode, a high-potential based pulse should be supplied to the individual electrode 35. Ideally, a pulse width is equal to a time T required for a pressure wave to propagate in one way through the individual ink passage 32 which extends from the outlet 5*c* of the sub manifold channel 5*a* through the pressure chamber 10 to the ejection opening of the nozzle 8. In this case, when negative pressure inside the pressure chamber 10 is reversed to positive pressure, both pressures are superimposed so that stronger pressure can be applied for ejecting ink.

For a gradation printing, a gradation is expressed based on the number of ink droplets ejected from the nozzle 8, i.e., based on the amount of ink which is controllable by the ink ejection frequency. Thus, the nozzle 8 corresponding to a predetermined dot region ejects ink droplets sequentially the number of times corresponding to a predetermined gradation expression. In sequentially ejecting ink droplets, it is generally preferable that an interval between pulses which are supplied to the individual electrode 35 is the time T described above. As a result, pressure generated in the pressure chamber 10 upon an ejection of an ink droplet leaves a pressure wave whose cycle coincides with a cycle of a pressure wave of pressure generated upon a subsequent ejection of an ink droplet, so that these pressure waves superimpose on each other to thereby amplify pressure which will be applied for ejecting the ink droplet.

Next, the controller 100 of the printer 1 will be described in detail with reference to FIG. 6.

The controller 100 includes a CPU (Central Processing Unit) which is an arithmetic processing unit, a ROM (Read Only Memory) for storing programs which will be executed by the CPU and data which will be used for the programs, a RAM (Random Access Memory) for temporarily storing data during execution of a program, and a driver IC (not shown) for driving the actuator unit 21, all of which integrally work to operate the following elements.

Figure 6:
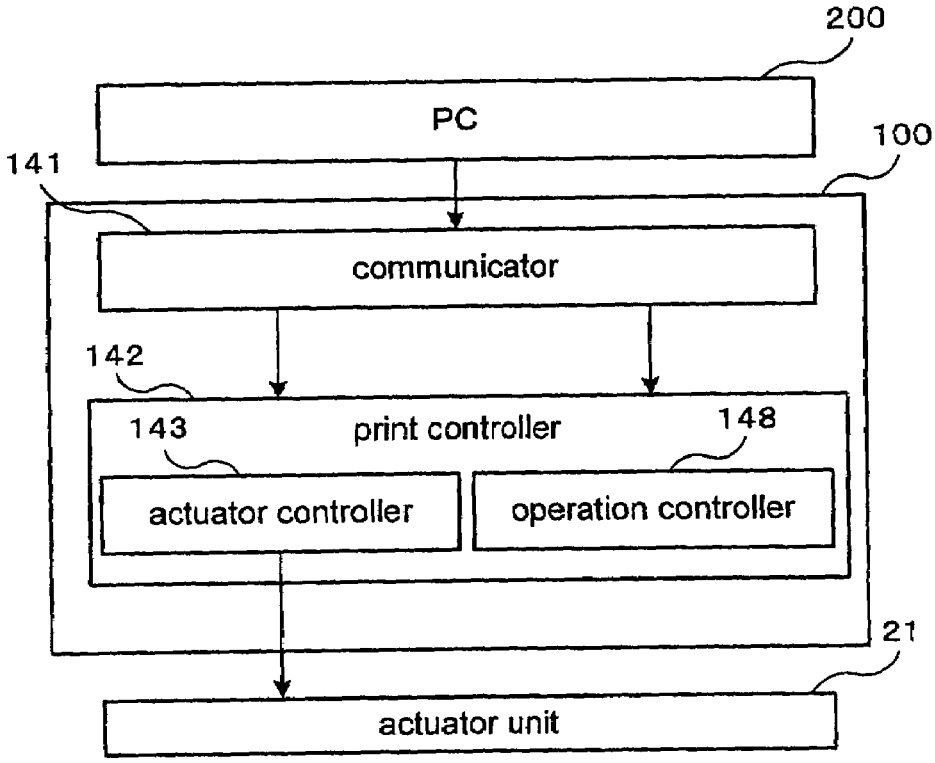
FIG. 6 is a block diagram of a controller of the printer.

The controller 100, which operates based on an instruction from a PC 200, includes a communicator 141 and a print controller 142 as shown in FIG. 6. The communicator 141 communicates with the PC 200. When the PC 200 sends a command, the communicator 141 analyzes execution contents thereof and then outputs analysis result to the print controller 142. The print controller 142, which controls a printing operation of the printer 1 based on the execution inputted from the communicator 141, includes an actuator controller 143 and an operation controller 148. The operation controller 148 controls the conveyance motor 74 (see FIG. 1), etc. The actuator controller 143 controls driving of the actuator unit 21. Each of the elements 141, 142, 143, and 148 is formed of a hardware including an ASIC (Application Specific Integrated Circuit), etc., but a whole or a part of the elements may be formed of software.

Next, the actuator controller 143 will be described in detail with reference to FIG. 7. The actuator controller 143 shown in FIG. 7 does not control a whole of the actuator unit 21 but controls a part of the actuator unit 21 corresponding to one sub manifold channel 5*a*. That is, the actuator controller 143 as shown in FIG. 7 is provided correspondingly for every sub manifold channel 5*a*.

Figure 7:
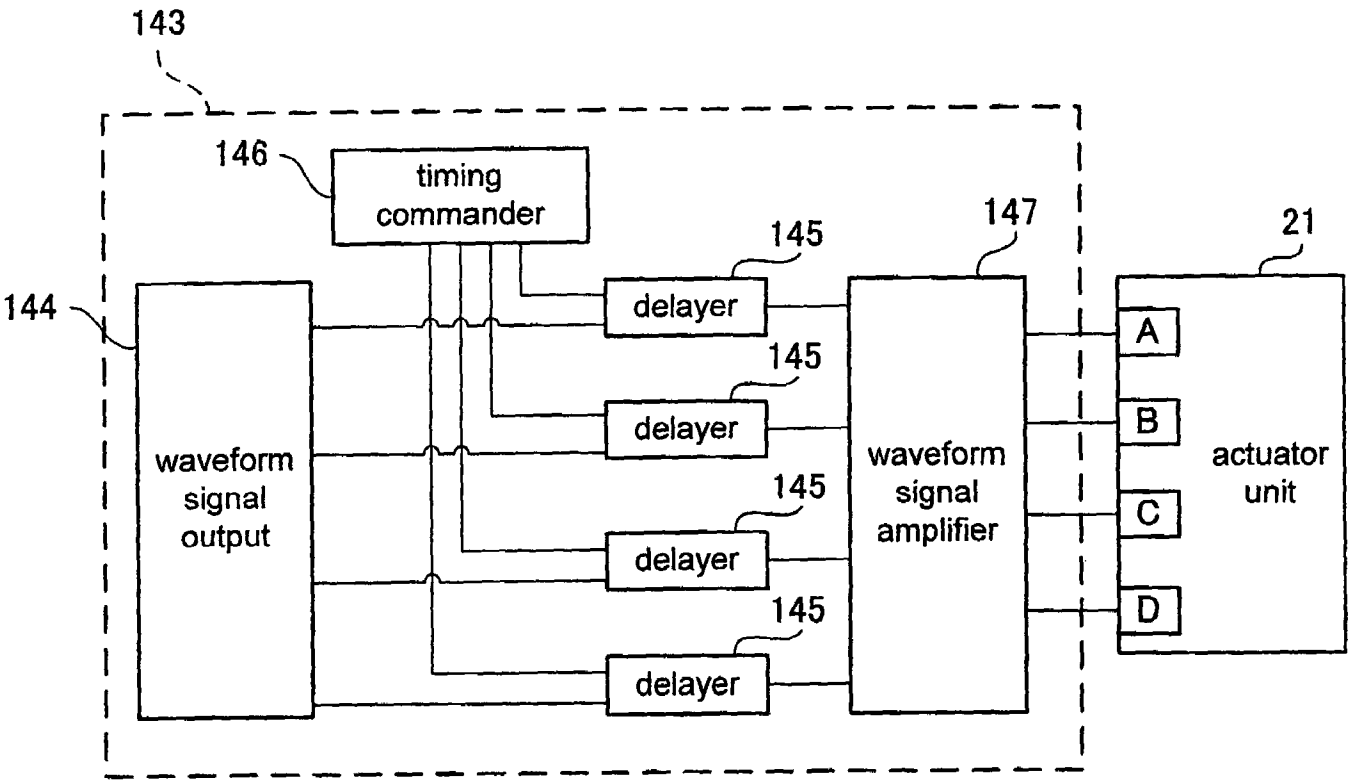
FIG. 7 is a block diagram of an actuator controller that is included in the controller.

As shown in FIG. 7, the actuator controller 143 includes a waveform signal output 144, four delayers 145, a timing commander 146, and a waveform signal amplifier 147. The waveform signal output 144, the delayers 145, and the timing commander 146 are made of digital circuits, and the waveform signal amplifier 147 is made of an analog circuit.

Based on the printing execution contents inputted from the communicator 141, the waveform signal output 144 generates and outputs a waveform signal 0 which corresponds to an ejection signal for ejecting from the nozzle 8 a desired volume of ink.

Figure 9:
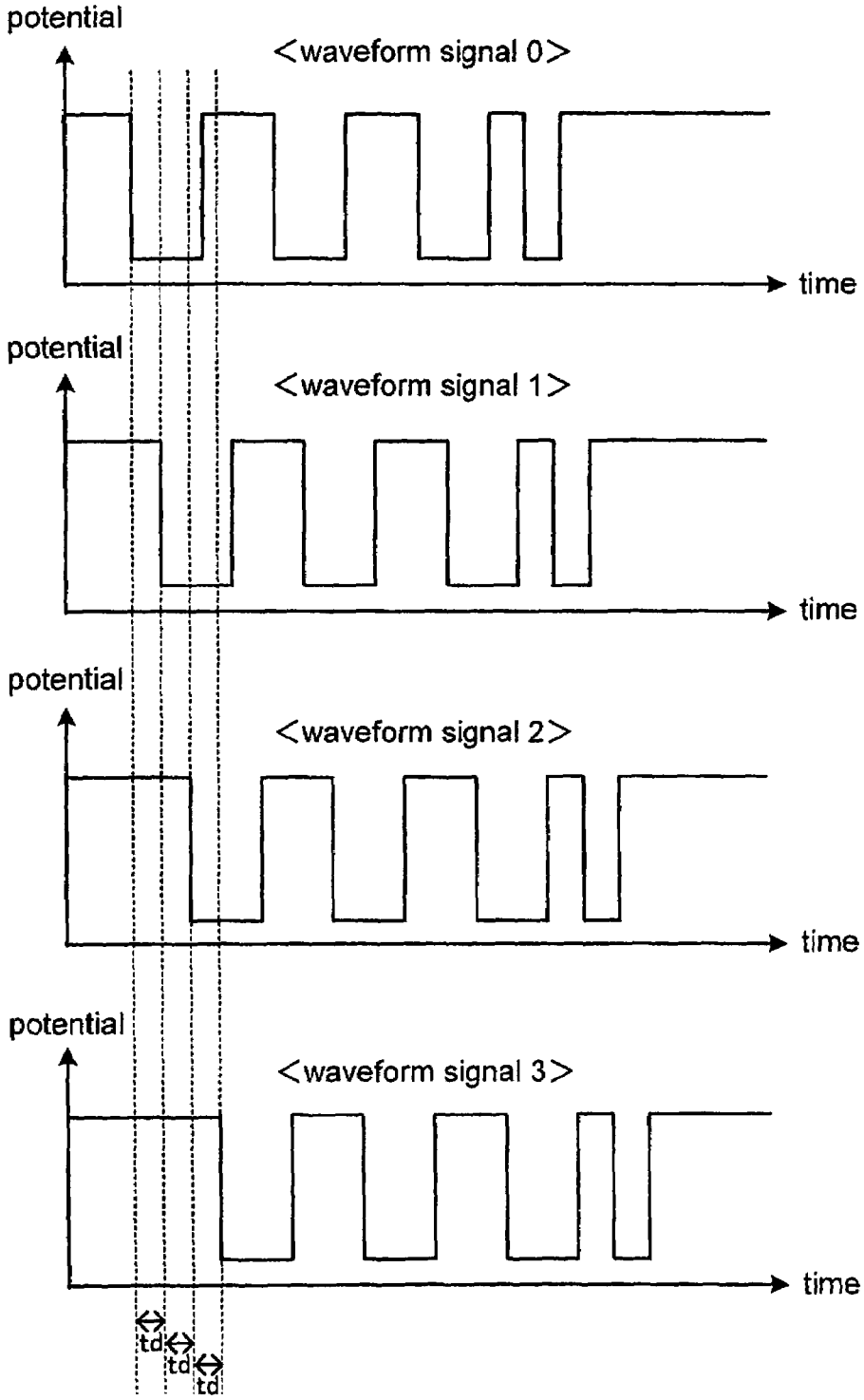
FIG. 9 illustrates four types of waveform signals outputted from a delayer that is included in the actuator controller.

Here will be described the waveform signal 0 with reference to FIG. 9. In this embodiment, as described above, while there is no ejection request the individual electrode 35 is kept at the high potential. The waveform signal 0 comprises three ejection pulses and one cancel pulse. The ejection pulse is for ejecting an ink droplet from the nozzle 8, and one ejection pulse serves to eject one ink droplet. The cancel pulse is for generating new pressure in the individual ink passage 32 having a cycle which is a reversed cycle of the cycle of the pressure left in the individual ink passage 32 after an ink ejection, to thereby remove the pressure left. The waveform signal 0 shown in FIG. 9 is just an example. The number of ejection pulses may be zero (where the cancel pulse is also zero), one, two, or four or more, in accordance with a desired gradation. In addition, other various configurations may be applied to the waveform signal.

The four delayers 145 correspond respectively to the rows A to D of outlets of the sub manifold channel 5*a* leading to the pressure chambers 10 or correspond respectively to the nozzle rows A' to D' (see FIG. 3). Each of the delayers 145 delays the waveform signal 0, which is outputted from the waveform signal output 144, by a delay time as commanded by the timing commander 146, and outputs a delayed waveform signal. In every two printing cycles, each of the four delayers 145 is commanded to delay the waveform signal 0 by a delay time of any one of zero, td, td×2, and td×3 without duplication. The delayed waveform signal is any one of four waveform signals 0, 1, 2, and 3 shown in FIG. 9 which correspond to the delay times zero, td, td×2, and td×3, respectively. Here, the printing cycle means a time required for the paper P to be conveyed by a unit distance corresponding to a printing resolution in the paper conveyance direction. For example, if a printing resolution in the paper conveyance direction is 600 dpi, the printing cycle is a time required for the paper P to be conveyed by 1/600 inch.

Every two printing cycles, the timing commander 146 commands each delayer 145 to delay the waveform signal 0 by different delay times among the four delay times of zero, td, td×2, and td×3. Depending on the delay time of the waveform signal, ink is ejected from the nozzle 8 at different timings. In each printing cycle, therefore, the outlet rows A to D or the nozzle rows A' to D' see different timings of ink ejection from the nozzles 8.

The waveform signal amplifier 147 amplifies the waveform signals 0 to 3 outputted from the delayers 145, and then supplies them to the individual electrodes 35 belonging to the outlet rows A to D, respectively.

Next, the timing commander 146 will be described in detail with reference to FIG. 8.

Figure 8:
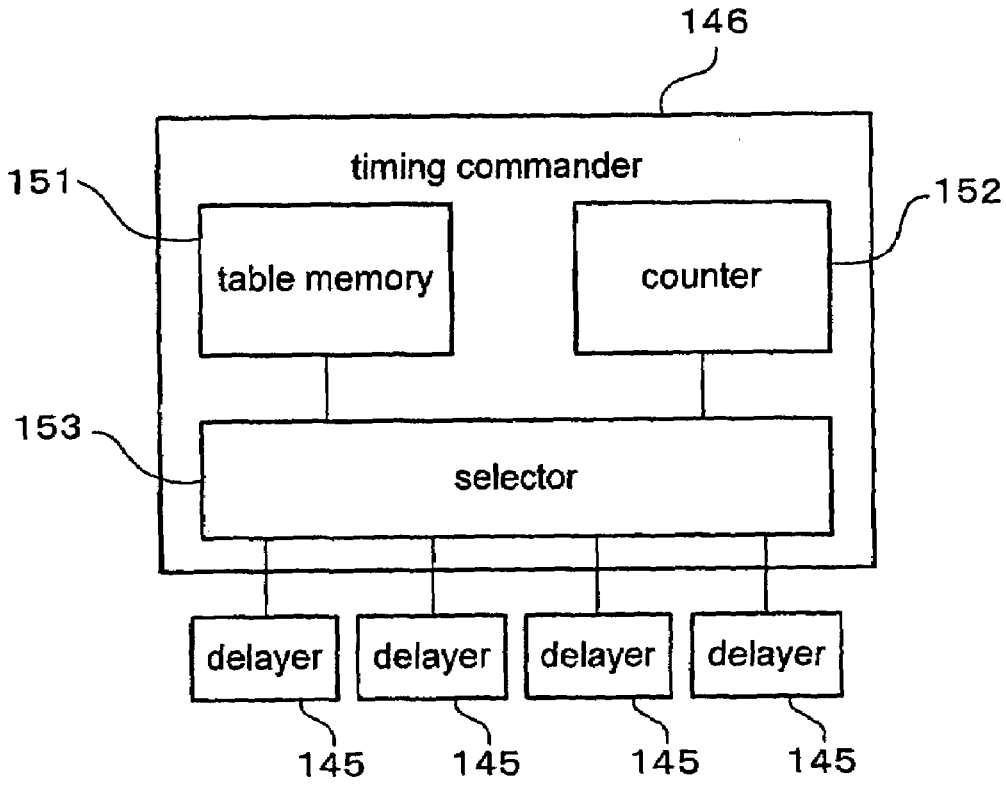
FIG. 8 is a block diagram of a timing commander that is included in the actuator controller.

As shown in FIG. 8, the timing commander 146 includes a table memory 151, a counter 152, and a selector 153. The table memory 151 stores therein combinations of delay times to be given to the respective delayers 145 which correspond to the respective outlet rows A to D (see TABLE 1).

TABLE 1

| Outlet row | Combination I | Combination II | Combination III | Combination IV |
|---|---|---|---|---|
| A | 0 | 2 | 3 | 1 |
| B | 1 | 0 | 2 | 3 |
| C | 2 | 3 | 1 | 0 |
| D | 3 | 1 | 0 | 2 |

In TABLE 1, "0", "1", "2", and "3" represent the delay times zero, td, td×2, and td×3, respectively. The pressure chambers 10, which respectively communicate with the outlets 5*c* belonging to the outlet rows A to D, are also arranged in rows. When the pressure chambers 10 are arranged closer to each other, the influence of mechanical crosstalk becomes non-negligible. In this embodiment, therefore, the delay time td is set at such a time that it may hardly be influenced by mechanical crosstalk caused between neighboring active portions. This means that a value of td is properly determined in accordance with a positional relation between pressure chambers 10 corresponding to active portions and rigidity of surroundings.

As shown in TABLE 1, in any of the combinations I, II, III, and IV, the outlet rows A to D are assigned different delay times from one another. In addition, these four combinations I, II, III, and IV have different delay times assigned to each one of the outlet rows A to D. In this embodiment, four combinations of delay times are shown, but two or more arbitrary number of combinations may also be acceptable.

The selector 153 selects any of the combinations of delay times I to IV which are stored in the table memory 151, and then commands each delayer 145 to delay the waveform signal 0 by a delay time of the selected combination. The selector 153 sequentially changes its selection among the combinations I to IV every two printing cycles in the order of I, II, III, and IV. As a result, timings of ink ejection from nozzles 8 belonging to the respective outlet rows A to D are changed every two printing cycles.

The combinations I to IV may be changed once in any natural number multiple of the printing cycle, as long as the combinations I to IV are changed at least once in a printing period which corresponds to a distance for the paper P to be conveyed at a spatial frequency of 5/mm in the paper conveyance direction. This is based on the fact that, at a spatial frequency of 5/mm or higher, visual sensitivity is small enough to make a noise inconspicuous, as will be detailed later with reference to FIG. 10. Here, the printing period means a certain time span during a series of printing actions.

The counter 152 stores therein which one of the combinations I to IV is currently employed by the selector 153 to command the delayers 145 to delay the waveform signals 0 by the delay times of the combination. The counter 152 increments its counter when the selector 153 changes the combinations of delay times I to IV.

Figure 10:
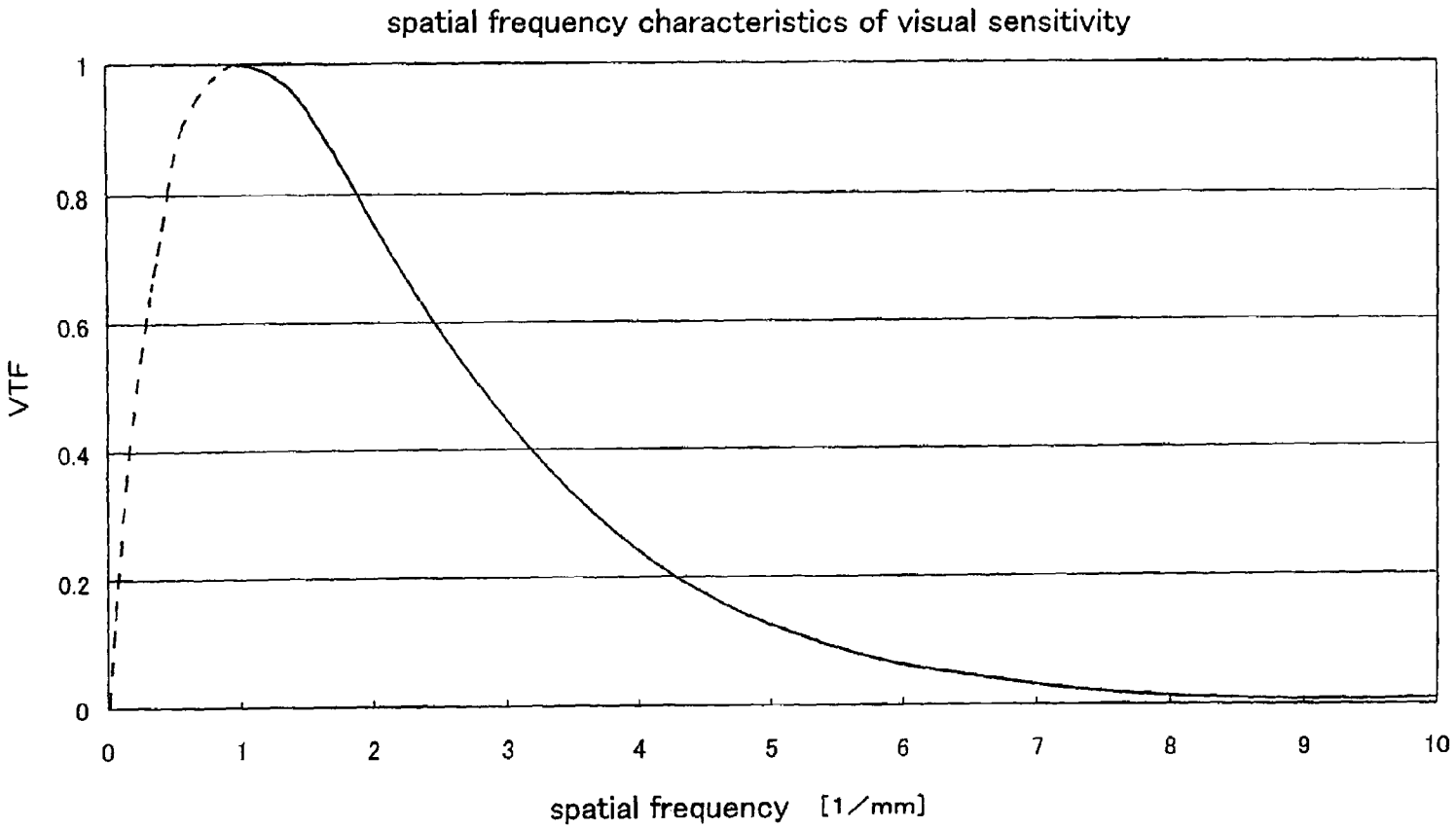
FIG. 10 is a graph showing spatial frequency characteristics of visual sensitivity.

The graph of FIG. 10 shows spatial frequency characteristics of visual sensitivity, i.e., a relation between a spatial frequency and a human visual sensitivity. A visual transfer function (VTF) plotted on the ordinate is obtained from an equation:

$$VTF=5.05\times\exp\{-0.138\times x\times f\times\pi/180\}\times\{1-\exp(-0.1\times x\times f\times\pi/180)\},$$

where x represents a viewing distance and f represents a spatial frequency. It can be seen from this graph that the visual sensitivity reaches its maximum when the spatial frequency is approximately 1/mm. This means that, when the printed paper P is viewed at a distance of 30 cm, a noise such as uneven density, un-uniform diameters and positions of dots, etc., which occurs once per 1 mm is identified most clearly. As a frequency of occurrence of a noise increases, the noise gradually becomes unidentifiable. That is, the higher the spatial frequency is, the lower the visual sensitivity to the noise becomes. For example, when clarity of noise at the spatial frequency of 1/mm is defined as 100, the clarity becomes approximately 10 at 5/mm and furthermore as small as approximately 1 at 8/mm. Thus, when the spatial frequency is 5/mm or higher, the visual sensitivity is small enough to make a noise inconspicuous.

By way of example, when a printing resolution in the paper conveyance direction is 600 dpi, an interval between ink dots with respect to this direction, i.e., a distance for the paper P to be conveyed in one printing cycle, is approximately 40 μm. In this embodiment, the combinations I to IV are changed every two printing cycles, i.e., once per the time for the paper P to be conveyed by approximately 80 μm. Thus, even if there arises influence of some kind of crosstalk during an ink ejection, the degree of this influence changes approximately at every 80 μm, which corresponds to the spatial frequency of approximately 12/mm. Hence, the noise is hardly seen. Particularly in a color printing, noise is more hardly seen.

In this embodiment, as shown in FIG. 9 and TABLE 1, an ejection signal is supplied to each of the actuators of the actuator unit 21 so that the respective outlet rows A to D communicating with one sub manifold channel 5*a* see different timings of ink ejection from the nozzles 8 in each printing cycle. In addition, since the selector 153 of the actuator controller 143 changes its selection among the combinations I to IV (see TABLE 1) every two printing cycles, a timing of ink ejections from each of the nozzles 8 belonging to the respective outlet rows A to D is varied. This suppresses fluid crosstalk produced via the sub manifold channel 5*a*.

To be more specific, each nozzle 8 sees an ink ejection timing which is not constant but changes over time. This prevents ink ejection characteristics from being influenced by a constant magnitude of fluid crosstalk produced via the sub manifold channel 5*a*. Consequently, noise does not occur over a so long distance on the paper P, and therefore it becomes harder to see the noise, so that print quality can be improved.

Further, the individual electrodes 35 of the actuator unit 21 corresponding to the respective outlet rows A to D are driven at different timings in each print cycle, and therefore timings of ink ejection from ejection openings of the nozzles 8 vary by the outlet rows A to D. Therefore, a peak value of current which is consumed by the actuator unit 21 can be held down.

Four fixed outlet rows A to D are provided for one sub manifold channel 5*a*, and nozzles 8 belonging to each one of the outlet rows A to D eject ink at the same timing. In such a case, a construction of the actuator controller 143 can be simplified and therefore controller 100 is downsized and costs are lowered, as compared with a case where a timing is not controlled on a fixed group basis such as a row basis, e.g., a case where spatially-scattered nozzles are grouped for timing control or a case where a way of grouping for timing control is changed depending on circumstances.

The outlet rows A to D formed in a row along the direction perpendicular to the paper conveyance direction differ from one another in timing of ink ejection from their corresponding nozzles 8. This makes it easy to predict the influence of fluid crosstalk produced via the sub manifold channel 5*a*. Therefore, more effective timing of ink ejection can be set in view of suppression of fluid crosstalk produced via the sub manifold channel 5*a*.

Four nozzle rows A' to D', which are formed in a row along the direction perpendicular to the paper conveyance direction similarly to the outlet rows A to D, are provided for one sub manifold channel 5*a*. Since the nozzle rows A' to D' differ from one another in ink ejection timing, a landing position of ink ejected from the nozzle 8 can easily be predicted. Therefore, more effective timing of ink ejection can be set in view of suppression of fluid crosstalk produced via the sub manifold channel 5*a*.

Based on the predetermined combinations I to IV stored in the table memory 151, the timing of ink ejection from the nozzles 8 is changed for each outlet row A to D as a unit. Due to this, the construction of the timing commander 146 of the actuator controller 143 can be simplified.

In this embodiment, the nozzles 8 communicating with one sub manifold channel 5*a* are provided with four different timings of ink ejection. As shown in TABLE 1, the combinations I to IV have different delay times assigned to each one of the outlet rows A to D. By sequentially changing the combinations I to IV every two printing cycles, the nozzles 8 belonging to each outlet rows A to D eject ink at four different timings within eight times the printing cycle. Like this, the timing of ink ejection from each nozzle 8 is variously changed within a predetermined time period. This can more effectively relieve the problem of fluid crosstalk produced via the sub manifold channel 5*a*.

As shown in FIG. 7, the actuator controller 143 includes the waveform signal output 144, the timing commander 146, the delayers 145, and the waveform signal amplifier 147, and is capable of digital-controlling a waveform corresponding to an ejection signal. This realizes further simplification of the construction of the actuator controller 143.

As shown in FIG. 8, the timing commander 146 of the actuator controller includes the table memory 151 that stores a timing of ink ejection from each nozzle 8 in each printing cycle. The timing commander 146 also includes the selector 153 that determines which one of four timings should be adopted as a timing of ink ejection from each nozzle 8 in each printing cycle. Since the timing commander 146 thus includes the table memory 151 and/or the selector 153, the timing of ink ejection from each nozzle 8 can be set efficiently in view of suppression of fluid crosstalk produced via the sub manifold channel 5*a*.

The actuator unit 21 includes the individual electrodes 35 that respectively correspond to many pressure chambers 10, the common electrode 34 that are formed corresponding to many individual electrodes, and the piezoelectric sheets 41 to 45, among of which one sheet 41 is sandwiched between many individual electrodes 35 and the common electrode 34. In other words, the actuator unit 21 is formed to extend over many pressure chambers 10, and has active portions sandwiched between the respective individual electrodes 35 and the common electrode 34 each corresponding to each pressure chamber 10. This construction may incur mechanical crosstalk, but in this embodiment the individual electrodes 35 of the actuator unit 21 corresponding to the respective outlet rows A to D are driven at different timings from one another, so that mechanical crosstalk can effectively be suppressed.

Next, a modification of the timing commander will be described with reference to FIG. 11.

Figure 11:
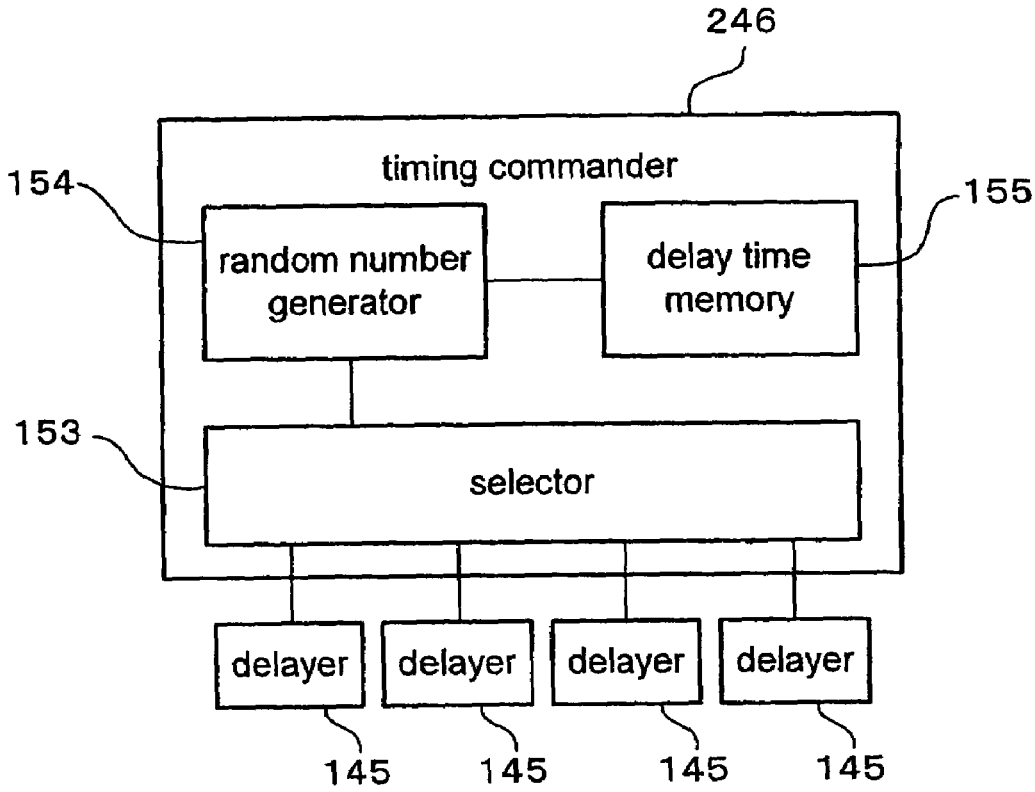
FIG. 11 is a block diagram of a modification of the timing commander shown in FIG. 8.

A timing commander 246 shown in FIG. 11 includes a random number generator 154 and a delay time memory 155 instead of the table memory 151 and the counter 152 of the timing commander 146 shown in FIG. 8. The random number generator 154 generates random numbers 0 to 3 used for determining a delay time by which each delayer 145 will be commanded to delay the waveform signal 0, in such a manner that the four outlet rows A to D may see different delay times from one another and at the same time in such a manner that the delay time may change in each of the outlet rows A to D. Here, the random numbers "0", "1", "2", and "3" represent delay times of zero, td, td×2, and td×3, respectively. The delay time memory 155 stores therein a delay times which are currently set for the respective outlet rows A to D. The selector 153 commands each delayer 145 to delay the waveform signal 0 by a delay time based on a random number generated by the random number generator 154.

In the modification shown in FIG. 11, a timing of ink ejection from each nozzle 8 is determined based on a random number generated by the random number generator 154 instead of the predetermined combinations I to IV employed in the foregoing embodiment. Since the timing of ink ejection from each nozzle 8 is changed at random, fluid crosstalk produced via the sub manifold channel 5*a* can be suppressed in a more effective way.

Next, with reference to FIG. 12, a description will be given to an actuator controller of an ink-jet printer according to the second embodiment of the present invention. In the following, the same members as those of the first embodiment are denoted by common reference numerals without a specific description thereof.

An actuator controller 243 of this embodiment, as well as the above-described actuator controller 143, controls a part of the actuator unit 21 corresponding to one sub manifold channel 5*a*. That is, the actuator controller 243 shown in FIG. 12 is provided for every sub manifold channel 5*a*.

Figure 12:
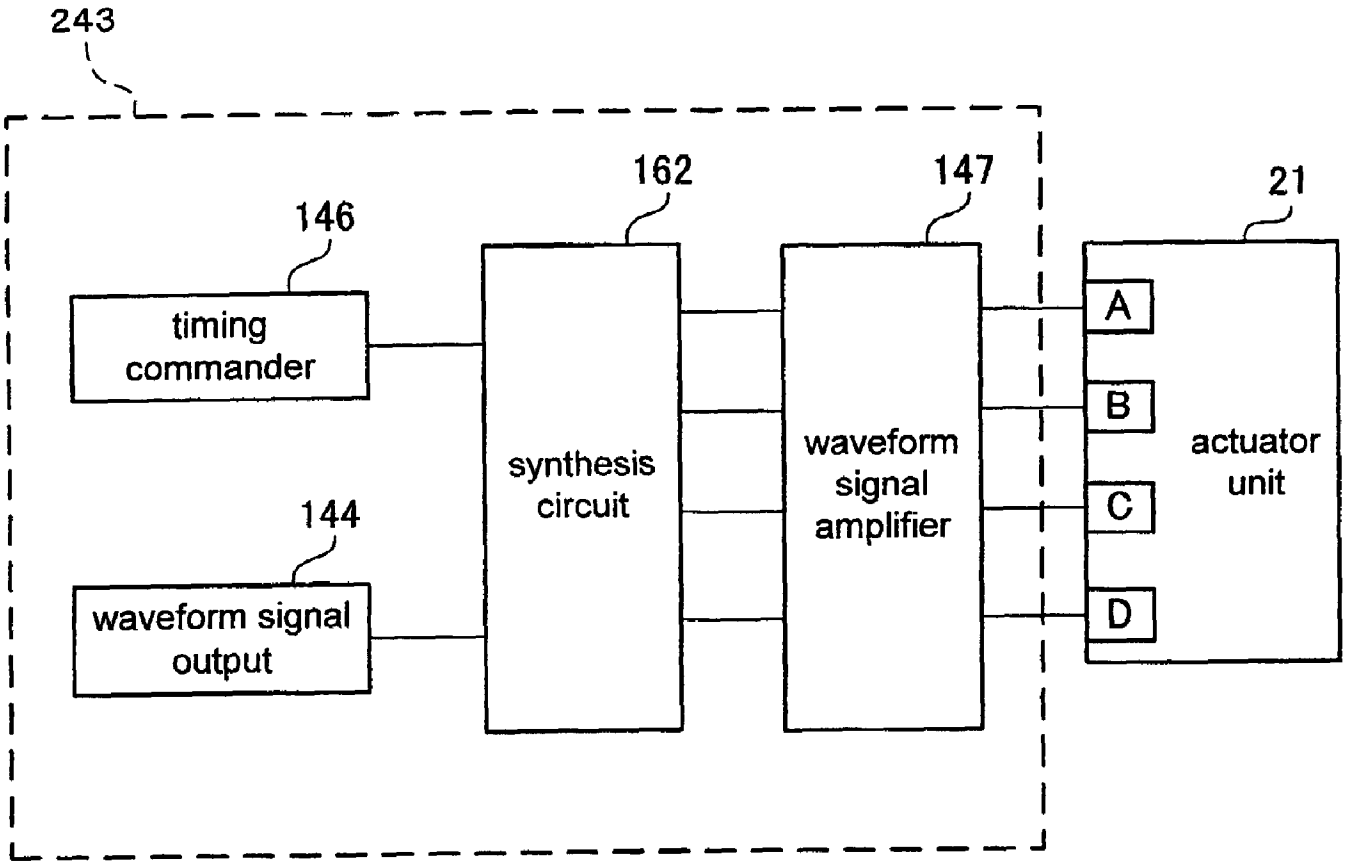
FIG. 12 is a block diagram of an actuator controller according to a second embodiment of the present invention.

As shown in FIG. 12, the actuator controller 243 includes a waveform signal output 144, a timing commander 146, a synthesis circuit 162, and a waveform signal amplifier 147, but does not include the four delayers 145 which are included in the above-described actuator controller 143.

The timing commander 146 outputs to the synthesis circuit 162 signals which are associated with different delay times each corresponding to each of the four outlet rows A to D.

For each of the outlet rows A to D, the synthesis circuit 162 synthesizes a signal associated with a delay time which is outputted from the timing commander 146 and a waveform signal 0 which is outputted from the waveform signal output 144, and then outputs resulting four synthesized signals to the waveform signal amplifier 147 respectively through respective lines.

The waveform signal amplifier 147 amplifies the four synthesized signals outputted from the synthesis circuit 162, and then supplies them to the individual electrodes 35 corresponding to the outlet rows A to D.

In this embodiment, differently from in the above-described first embodiment, the four delayers 145 corresponding individually to the respective outlet rows A to D are not provided but the synthesis circuit 162 shared among the four outlet rows A to D is provided instead. In other words, for each one of the four outlet rows A to D, the synthesis circuit 162 synthesizes the signal associated with a delay time and a waveform signal 0. Therefore, there is no need to provide a waveform-generating circuit and a delay circuit for each of the outlet rows. A to D. Thus, a digital circuit of the controller can be downsized to lower costs of the controller.

In the above embodiments, the nozzles 8 are classified into the nozzle rows A' to D' that correspond to the outlet rows A to D, respectively, and timing of ink ejection from one nozzle row is controlled independently of timing of ink ejection from another row. However, control of the timing is not necessarily conducted on a row basis. In addition, a grouping for timing control may not be fixed, but can be changed depending on circumstances. Moreover, the number of nozzles belonging to a group may be one.

In the above embodiments, each nozzle 8 ejects ink at four different timings within a printing period of eight times the printing cycle. However, this is not limitative. For example, each nozzle 8 may eject ink at two or three different timings within a printing period. In addition, the combinations I to IV may be changed every three printing cycles.

In the first embodiment, the printing period corresponds to a distance for the paper P to be conveyed in correspondence to a spatial frequency of 5/mm or higher in the paper conveyance direction. However, the printing period may also correspond to a distance for the paper P to be conveyed in correspondence to a spatial frequency of 2/mm or higher in the paper conveyance direction. It is more preferable that the printing period corresponds to a distance for the paper P to be conveyed in correspondence to a spatial frequency of 3/mm or higher in the paper conveyance direction. It is further preferable that the printing period corresponds to a distance for the paper P to be conveyed in correspondence to a spatial frequency of 4/mm or higher in the paper conveyance direction. It is still further preferable that the printing period corresponds to a distance for the paper P to be conveyed in correspondence to a spatial frequency of 6/mm or higher in the paper conveyance direction. It is most preferable that the printing period corresponds to a distance for the paper P to be conveyed in correspondence to a spatial frequency of 7/mm or higher in the paper conveyance direction.

In the above embodiment, the actuator is a portion of the actuator unit 21 which extends over many pressure chambers 10. However, each actuator may include a single piezoelectric sheet independently disposed at a portion corresponding to a single pressure chamber 10, and a single individual electrode independently disposed on the single piezoelectric sheet.

Although in the above embodiment the actuator unit 21 of piezoelectric type is adopted, other various types of actuators such as a so-called thermal type one which applied ejection energy to ink contained in a pressure chamber 10 by means of heating may be adopted.

An application of the present invention is not limited to the printer described above. The present invention is also applicable to an ink-jet type facsimile or copying machine.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A line-type ink-jet recording apparatus comprising:

a conveyance mechanism that conveys a print medium;

a passage unit provided with one or more common ink chambers that store ink and a plurality of individual ink passages each extending from an outlet of each common ink chamber through a pressure chamber to an ejection opening, the passage unit extending in a direction intersecting a conveyance direction for the print medium which is conveyed by the conveyance mechanism;

a plurality of actuators that apply ejection energy to ink contained in respective pressure chambers so that the ink is ejected from ejection openings communicating with the pressure chambers; and an actuator controller that supplies an ejection signal to each of the actuators so that ink is ejected from n ejection openings communicating with the same common ink chambers at m different timings within one printing cycle and that ink is ejected from each of the n ejection openings at two or more different timings among the m timings within a printing period including two or more of the printing cycles, the printing cycle representing a time required for the print medium to be conveyed by a unit distance corresponding to a printing resolution with respect to the conveyance direction, wherein n is a natural number no less than 2 and m is a natural number no less than 2 and equal to or less than n, wherein a distance for the print medium to be conveyed within the printing period is a distance that corresponds to a spatial frequency of 5/mm or higher with respect to the conveyance direction.

2. The apparatus according to claim 1, wherein the n ejection openings are classified into m fixed groups, and the actuator controller supplies an ejection signal to each of the actuators so that ink is ejected from ejection openings belonging to the group at the same timing.

3. The apparatus according to claim 2, wherein the actuator controller supplies an ejection signal to each of the actuators so that a timing of ink ejection from ejection openings belonging to one of the m groups is different from a timing of ink ejection from ejection openings belonging to another group of the m groups within the one printing cycle.

4. The apparatus according to claim 2, wherein outlets of one of the common ink chambers belonging to each of the groups are disposed in a row along a direction perpendicular to the conveyance direction, so that m outlet rows are formed.

5. The apparatus according to claim 2, wherein the n ejection openings belonging to each of the groups are disposed in a row along a direction perpendicular to the conveyance direction, so that m ejection-opening rows are formed.

6. The apparatus according to claim 1, wherein the actuator controller supplies an ejection signal to each of the actuators so that a timing of ink ejection from each ejection opening is changed in a predetermined pattern.

7. The apparatus according to claim 1, wherein the actuator controller supplies an ejection signal to each of the actuators such that the timing of ink ejection from each group of ejection openings is changed at random every one or more of the printing cycles.

8. apparatus according to claim 1, wherein the actuator controller supplies an ejection signal to each of the actuators so that ink is ejected from each ejection opening at all of the m different timings within the printing period.

9. The apparatus according to claim 1, wherein the actuator controller comprises:

a waveform signal output that outputs a waveform signal corresponding to the ejection signal;

a timing commander that commands which one of the m timings is adopted as a timing of ink ejection from each of the n ejection openings;

a delayer that, in accordance with a command given by the timing commander, delays the waveform signal for each of the m timings; and an amplifier that amplifies the waveform signal delayed by the delayer.

10. The apparatus according to claim 9, wherein the timing commander includes a memory that stores a timing of ink ejection from each ejection opening in each of the printing cycles.

11. The apparatus according to claim 9, wherein the timing commander includes a determiner that determines which one of the m timings is adopted as a timing of ink ejection from each ejection opening in each of the printing cycles.

12. The apparatus according to claim 1, wherein the actuators form an actuator unit that includes a plurality of individual electrodes corresponding to the respective pressure chambers and each is supplied with the ejection signal from the actuator controller, a common electrode formed to correspond to the plurality of individual electrodes, and a piezoelectric sheet sandwiched between the individual electrodes and the common electrode.

13. The apparatus according to claim 1, wherein the n ejection openings communicate with a predetermined region of the one of the common ink chambers.

14. The apparatus according to claim 13, wherein the predetermined region has a slender shape elongated in one direction.

15. The apparatus according to claim 9, wherein the n ejection openings communicate with a predetermined region of the one of the common ink chambers.

* * * * *

UNITED STATES PATENT AND TRADEMARK OFFICE

CERTIFICATE OF CORRECTION

PATENT NO. : 7,445,306 B2
APPLICATION NO. : 11/224289
DATED : November 4, 2008
INVENTOR(S) : Atsushi Hirota It is certified that error appears in the above-identified patent and that said Letters Patent is hereby corrected as shown below:

In Column 15, Line 15 (Claim 8):
Please insert the word "The" before "apparatus".

Signed and Sealed this

Fourteenth Day of July, 2009

John Doll

JOHN DOLL
*Acting Director of the United States Patent and Trademark Office*